United States Patent [19]

Elsner et al.

[11] Patent Number: 4,498,185

[45] Date of Patent: Feb. 5, 1985

[54] PROCESS FOR PREVENTING BURN-OFF ON A CURRENT-CONDUCTING ELECTRODE FOR METALLURGICAL FURNACES AND ELECTRODES

[75] Inventors: Emil Elsner; Dietfried Reiber, both of Gerlafingen; Josef Messmer; Peter Kaiser, both of Biberist, all of Switzerland

[73] Assignee: Von Roll AG, Gerlafingen, Switzerland

[21] Appl. No.: 434,381

[22] Filed: Oct. 14, 1982

[30] Foreign Application Priority Data

Oct. 15, 1981 [CH] Switzerland ..... 6605/81

[51] Int. Cl.[3] ..... H05B 7/08

[52] U.S. Cl. ..... 373/93

[58] Field of Search ..... 373/93

[56] References Cited

U.S. PATENT DOCUMENTS

| | | | |
|---|---|---|---|
| 3,392,227 | 7/1968 | Ostberg | 373/93 |
| 4,256,918 | 3/1981 | Schwabe et al. | 373/93 |
| 4,291,190 | 9/1981 | Elsner et al. | 373/93 |

*Primary Examiner*—A. D. Pellinen
*Assistant Examiner*—Susan Steward
*Attorney, Agent, or Firm*—Murray Schaffer

[57] ABSTRACT

The electrode has a durable upper part and a consumable tip. A plurality of copper tubes extend through the upper part. The connection to the consumable tip is by means of an intermediate plate and a nipple, the latter containing ducts for the connection of the copper tubes. At the upper end of the electrode, the copper tubes are serially interconnected by tube bends and at their lower end by ducts in the nipple.

7 Claims, 3 Drawing Figures

PROCESS FOR PREVENTING BURN-OFF ON A CURRENT-CONDUCTING ELECTRODE FOR METALLURGICAL FURNACES AND ELECTRODES

BACKGROUND OF THE INVENTION

The invention relates to a process for preventing burn-off on peripheral surfaces of a current-conducting electrode for metallurgical surfaces, which comprises a durable upper part and a consumable tip and which is cooled in the upper part, as well as a current-conducting electrode for performing the process.

It is conventional practice to use graphite or carbon electrodes for operating metallurgical furnaces, e.g. electric furnaces for smelting steel scrap. However, as the electrodes are subject to continuous burn-off during smelting, they must periodically be at least partly replaced. The raw materials for producing such electrodes are becoming increasingly scarce and are also subject to continuous price increases, so that the electrode cost proportion in metallurgical processes is correspondingly increasing.

In the case of arc furnaces, for example, the consumption of graphite electrodes is as follows. Of the total consumption, approximately 50% is burn-off of the electrode tip, approximately 45% lateral electrode burn-off and approximately 5% losses by electrode waste.

Numerous efforts have been made to reduce the consumption of graphite electrodes. As tip burn-off is due to the operation of the furnace, these efforts have mainly been directed at reducing lateral burn-off. Electrodes are known in which the upper part is made from a metal, e.g. a copper tube cooled by a cooling medium, instead of being made from graphite. A consumable graphite tip is fixed to this upper part by means of a graphite or metal thread nipple. The metal electrode portions of the upper part have the disadvantage that they are subject to higher thermal losses and there is a risk of burn-through on contact with conductive parts, e.g. steel scrap. To avoid the latter disadvantage, it has been proposed to peripherally electrically insulate the metal electrode portions. The known insulants used for this do not, however, have an adequate durability. A further disadvantage is that such metal electrode portions can only be secured with difficulty in conventional electrode holders and problems occur when power is supplied.

It is also known to coat or impregnate the graphite electrode portions to prevent lateral burn-off. However, both processes are very complicated and costly. In addition, problems can occur in the electrode holder when supplying power.

The problem of the present invention is therefore to further develop a process of the aforementioned type that a considerable reduction of lateral burn-off can be achieved with acceptable expenditure and effort, without modifying the external shape of the electrode or providing additional measures.

SUMMARY OF THE INVENTION

According to the invention, this problem is solved in that the durable upper part is made from graphite or carbon and is cooled to below the burn-off temperature by a cooling medium led into it.

The electrodes used for performing the process have a durable upper part with more than two metal tubes, e.g. of copper extending longitudinally over the entire length of the upper part which are serially interconnected and in which circulates the cooling medium.

BRIEF DESCRIPTION OF THE DRAWINGS

The invention is described in greater detail hereinafter relative to non-limitative embodiments and the attached drawings, wherein shown.

DESCRIPTION OF THE INVENTION

Figure 1:
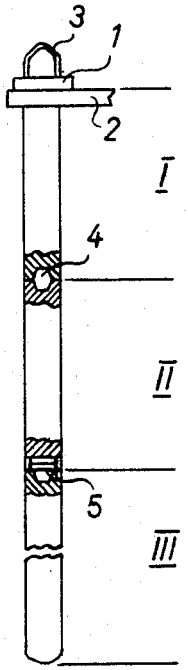
FIG. 1 a view of a current-conducting electrode.

The current-conducting electrode illustrated in FIG. 1 comprises three electrode portions I, II and III. Portions I and II form the durable upper part and portion III the consumable tip of the electrode. The upper end of the electrode is covered by a cover plate 1, which projects over the electrode cross-section to prevent its slipping through the electrode holder 2, a part of which is seen below the plate 1. The holder 2 serves to receive the electrode in conventional and not further shown manner. A U-shaped handle member 3 is also fixed to cover plate 1.

The electrode portions I, II and III are firmly screwed down axially to each other by threaded nipples 4, 5 arranged at the center of the electrode cross-section. Threaded nipple 4 can also be made from graphite or copper, whereas threaded nipple 5 is, as shown, preferably made from copper. In the place of the nipple 4, it is possible to use a tongue and groove joint. The electrode need not be formed with three portions I, II and III shown in FIG. 1, since the upper portion can either be made from a single electrode part or from more than two electrode parts.

Figure 2:
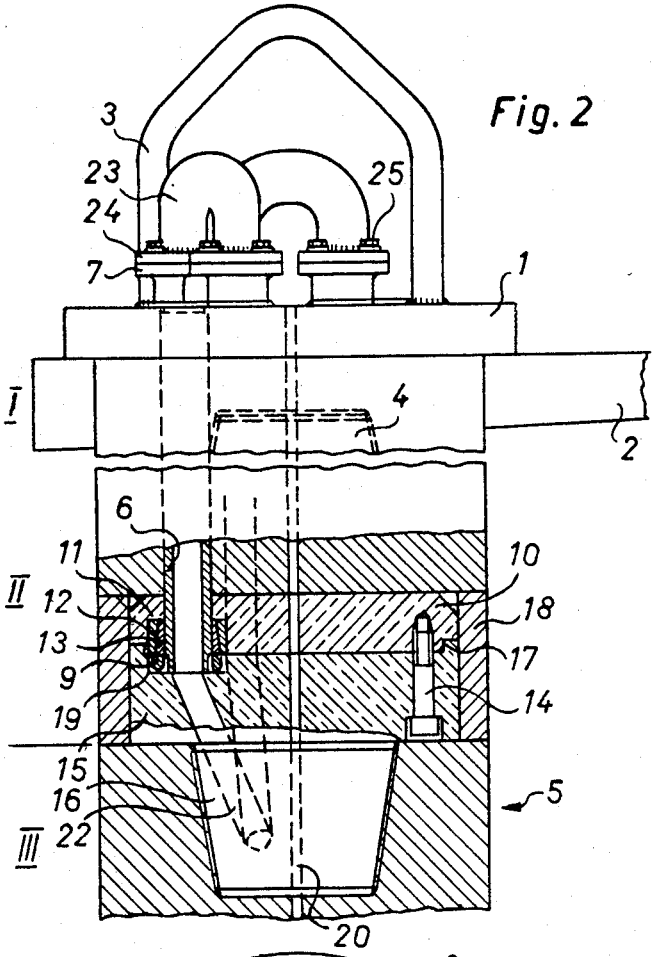
FIG. 2 a larger-scale view of the electrode of FIG. 1, partly in section.
Figure 3:
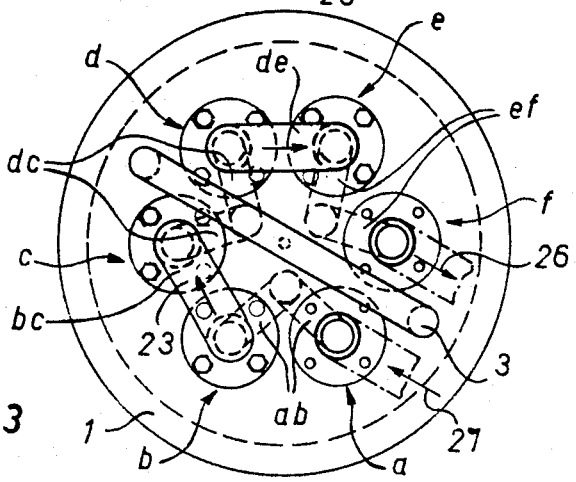
FIG. 3 a plan view of the electrode of FIG. 2.

The construction of the electrode assembly according to the invention is described by means of FIGS. 2 and 3. The nipple 4 is not completely shown in FIG. 2, because it is unchanged compared with known constructions. According to the invention a number of copper tubes 6, one being shown in FIG. 2, are embedded in the electrode material of the upper part to extend through electrode portions I and II. The ends of the copper tubes 6 are provided with an external thread. Onto each of the top ends a flanged nut 7 is screwed while onto each of the bottom ends a nut 9 is fastened.

On the lower end of the upper part there is provided an intermediate part in the form of a plate 10, through which extends the copper tubes 6 and which is held by nuts 9. At each tube opening in the intermediate plate 10, there is a recess 11, in which are inserted concentrically two soft copper conical rings 12, 13 which are pressed together by nuts 9, so that a good conducting contact is obtained between copper tube 6 and intermediate plate 10. However, only a single conical ring need be used, but then recess 11 would also have to conical. Copper tubes 6 with their nuts 7, 9 form tie rods, with which the electrode portions I, II are secured together. The durable upper part is significantly reinforced by the copper tubes 6 on the one hand and by the prestressing of nuts 7, 9 on the other.

The lower part or nipple 5 is firmly screwed to the intermediate plate 10 by means of screws 14. Nipple 5 comprises a cylindrical portion 15 abutting the intermediate plate 10 and a depending conical threaded portion 16. Intermediate plate 10 and cylindrical portion 15 of nipple 5 are centered by shoulder projection and setback 17 and are surrounded by a graphite ring 18. To ensure a completely satisfactory contact between the end of copper tube 6 and nipple portion 15, a gasket 19, e.g. of silver is inserted therebetween. The intermediate plate 10 and nipple 5 are appropriately made from copper.

The consumable electrode tip III is firmly screwed onto the conical threaded portion 16. In the center of the electrode an axial bore 20 is provided, through which gases can be supplied to the arc area.

By means of copper tubes 6, a cooling medium, e.g. water maybe forcibly introduced enabling the durable upper part to be cooled to such an extent that no burnoff occurs on its peripheral surface. This is the case if e.g. with graphite electrodes the temperature is kept below 600° C.

As can be gathered from FIG. 3, the tubes are arranged in an annular series, i.e. in succession uniformly spaced about the central axis. In the example of FIG. 3, there are six copper tubes 6 arranged in through-flow order a-b-c-d-e-f. Inlet 21 for the entry of the cooling medium into tube a is provided. Ducts 22 (FIG. 2) are drilled in the threaded portion 16 of the nipple 15 which are connected to the copper tubes 6 and provided the connection to the adjacent copper tube 6. From tube a, the cooling medium flows through nipple 5 and passes through corresponding ducts into tube b. At the upper end, the tubes are interconnected by means of tube elbows 23, which are provided with flanges 24 and are screwed onto nut 7 by means of screws 25. The flange of nuts 7 is for this purpose made sufficiently large so that flange 24 of tube elbows 23 can be screwed down. From tube b, the cooling medium flows via elbow bc into tube c, then via duct cd in nipple 5 into tube d, from there via tube elbows de into tube e, from there via ducts ef into tube f and from there into the drain indicated by arrow 26. The advantage of the series connection of the copper tube 6 is that it is only necessary to have one inlet and one outlet for the cooling medium. However, it would also be possible to partly arrange the copper tube 6 in series and partly in parallel.

Since the construction according to the invention of the durable upper part of the electrode does not alter the external shape, the hitherto used electrode holder can be employed, so that no constructional changes are necessary thereto. A completely satisfactory current flow is ensured, which, in conventional manner, passes from the clamping jaws of electrode holder 2 to the graphite in electrode portion 1.

We claim:

1. An electrode for electric arc furnaces for the production of iron and steel comprising, a liquid cooled upper portion adapted to be inserted into an electrode holder connected to a source of electricity and having at least said upper portion contacting said holder formed of graphite and/or carbon for the conduction of said electricity, and a lower portion forming a consumable electrode tip detachably fastened to said upper portion, said upper portion including a conduit system for cooling liquid comprising at least three copper tubes extending longitudinally through said upper portion and spaced uniformly about the central axis thereof, the upper end of one of said tubes having an inlet for cooling liquid and the upper end of another of said tubes having an outlet for cooling liquid and said remaining upper and lower ends of said tubes being serially connected to provide a continuous flow of liquid from inlet to outlet, said upper portion comprising a separable upper part, a lower part having a threaded nipple for the removable attachment of said consumable electrode tip and an intermediate part, said conduit cooling system comprising straight copper tubes embedded in said upper part and extending outwardly from the top thereof and from the bottom thereof through said intermediate part, each tube having means at the top and bottom ends for securing said upper and lower parts in fixed abutment together, said conduit cooling system including shaped ducts in the lower part registering with said straight tubes to interconnect the bottom ends thereof and elbows interconnecting the tops thereof, and screw means securing said lower part to said intermediate part.

2. The electrode according to claim 1, including conductive metal gaskets between the lower part and the bottom ends of the copper tubes extending from said intermediate part.

3. The electrode according to claim 2, including conductive packing rings between the intermediate part and the bottom ends of the copper tubes extending therefrom.

4. The electrode according to claim 3, wherein the packing rings and gasket are made of copper.

5. The electrode according to claim 1, wherein the lower part is made of copper.

6. The electrode according to claim 5 wherein the intermediate part is made of copper.

7. The electrode according to claim 3, wherein the packing rings and gasket are made of silver.

* * * * *